US008216058B2

(12) United States Patent
Anderson et al.

(10) Patent No.: US 8,216,058 B2
(45) Date of Patent: Jul. 10, 2012

(54) PROVIDING ALTERNATIVE PERSISTENT STATE RECOVERY TECHNIQUES

(75) Inventors: Peter R. Anderson, Glenview, IL (US); Joel R. Jaffe, Glenview, IL (US); Jim Motyl, Chicago, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 919 days.

(21) Appl. No.: 12/279,834

(22) PCT Filed: Feb. 16, 2007

(86) PCT No.: PCT/US2007/004062

§ 371 (c)(1),
(2), (4) Date: Aug. 18, 2008

(87) PCT Pub. No.: WO2007/098017

PCT Pub. Date: Aug. 30, 2007

(65) Prior Publication Data

US 2010/0240442 A1 Sep. 23, 2010

Related U.S. Application Data

(60) Provisional application No. 60/743,318, filed on Feb. 17, 2006, provisional application No. 60/747,496, filed on May 17, 2006, provisional application No. 60/828,888, filed on Oct. 10, 2006.

(51) Int. Cl.
*A63F 9/24* (2006.01)

(52) U.S. Cl. ..... 463/24; 463/25; 463/42

(58) Field of Classification Search ..... 463/24, 463/25, 42

See application file for complete search history.

(56) References Cited

U.S. PATENT DOCUMENTS

| | | | | |
|---|---|---|---|---|
| 6,117,013 | A | 9/2000 | Eiba | |
| 6,662,281 | B2 * | 12/2003 | Ballard et al. | 711/162 |
| 6,755,742 | B1 * | 6/2004 | Hartman et al. | 463/40 |
| 6,811,486 | B1 * | 11/2004 | Luciano, Jr. | 463/24 |
| 7,278,068 | B1 * | 10/2007 | Crowder, Jr. | 714/100 |
| 2002/0094871 | A1 * | 7/2002 | Luciano et al. | 463/43 |
| 2003/0027628 | A1 | 2/2003 | Luciano | |
| 2003/0224852 | A1 | 12/2003 | Walker et al. | |

(Continued)

FOREIGN PATENT DOCUMENTS

DE 10304725 A1 9/2004

(Continued)

OTHER PUBLICATIONS

"European Application Serial No. 06839061.6, Extended European Search Report mailed Feb. 2, 2011", 11 pgs.

(Continued)

*Primary Examiner* — Peter DungBa Vo
*Assistant Examiner* — Steve Rowland
(74) *Attorney, Agent, or Firm* — Schwegman, Lundberg & Woessner, P.A.

(57) ABSTRACT

This document discusses, among other things, systems and methods for alternative persistent state recovery methods. A method comprises detecting persistent state recovery information from one of two or more persistent state recovery techniques, wherein the persistent state recovery information identifies a persistent state in a wagering game; and restoring the persistent state of the wagering game from the detected persistent state recovery information.

18 Claims, 9 Drawing Sheets

U.S. PATENT DOCUMENTS

| | | | | |
|---|---|---|---|---|
| 2003/0225834 | A1 | 12/2003 | Lee et al. | |
| 2003/0232651 | A1 | 12/2003 | Huard et al. | |
| 2004/0075769 | A1 | 4/2004 | Shy et al. | |
| 2004/0198494 | A1* | 10/2004 | Nguyen et al. | 463/42 |
| 2004/0257434 | A1 | 12/2004 | Davis et al. | |
| 2005/0024532 | A1 | 2/2005 | Choi | |
| 2005/0096128 | A1 | 5/2005 | Walker et al. | |
| 2005/0170893 | A1* | 8/2005 | Muir et al. | 463/42 |
| 2005/0233811 | A1 | 10/2005 | Gatto | |
| 2005/0239546 | A1* | 10/2005 | Hedrick et al. | 463/29 |
| 2005/0256985 | A1 | 11/2005 | Shea | |
| 2005/0270303 | A1 | 12/2005 | Li | |
| 2006/0035707 | A1 | 2/2006 | Nguyen et al. | |
| 2006/0040741 | A1 | 2/2006 | Griswold et al. | |
| 2006/0154722 | A1* | 7/2006 | Walker et al. | 463/25 |
| 2006/0205513 | A1* | 9/2006 | Breckner et al. | 463/43 |
| 2006/0205514 | A1* | 9/2006 | Cockerille et al. | 463/43 |
| 2006/0281554 | A1* | 12/2006 | Gatto et al. | 463/42 |
| 2007/0207854 | A1* | 9/2007 | Wolf et al. | 463/29 |
| 2007/0298856 | A1 | 12/2007 | Gilmore et al. | |
| 2008/0096671 | A1* | 4/2008 | Gagner et al. | 463/43 |
| 2008/0300049 | A1 | 12/2008 | Anderson et al. | |
| 2010/0234099 | A1 | 9/2010 | Rasmussen et al. | |

FOREIGN PATENT DOCUMENTS

| | | | |
|---|---|---|---|
| EP | 1422673 | A1 | 5/2004 |
| JP | 2005033721 | | 2/2005 |
| WO | WO-9850889 | A1 | 11/1998 |
| WO | WO-0195608 | A2 | 12/2001 |
| WO | WO-03089078 | A1 | 10/2003 |
| WO | WO-2007078533 | A2 | 7/2007 |
| WO | WO-2007078533 | A3 | 7/2007 |
| WO | WO-2007098017 | A2 | 8/2007 |
| WO | WO-2007098017 | A3 | 8/2007 |

OTHER PUBLICATIONS

"International Application Serial No. PCT/US2007/04062, International Search Report and Written Opinion mailed Aug. 20, 2008", 9 pgs.

"U.S. Appl. No. 12/158,855 , Response filed Jul. 19, 2011 to Non Final Office Action mailed Apr. 19, 2011", 16 pgs.

"U.S. Appl. No. 12/158,855, Non Final Office Action mailed Apr. 19, 2011", 18 pgs.

Brandon, Alexander, "Audio for Games: Planning, Process and Production", New Riders, (Oct. 7, 2004), 42-44.

Evry, Harry J, "Beginning Game Graphics", Course Technology PTR, (Jan. 1, 2005), 26-29,38-42,44.

Morrison, Michael, "Beginning Game Programming", Sams, (Jul. 19, 2004), 203-205,264-266.

Mueller, Scott, "Upgrading and Repairing PCs", Que, Sixteenth Edition, (Aug. 27, 2004), 881-883,917-918,932-933.

* cited by examiner

PROVIDING ALTERNATIVE PERSISTENT STATE RECOVERY TECHNIQUES

RELATED APPLICATIONS

This patent application is a U.S. National Stage Filing under 35 U.S.C. 371 from International Patent Application Serial No. PCT/US2007/004062, filed Feb. 16, 2007, and published on Aug. 30, 2007 as WO 2007/098017 A2, which claims the benefit of priority, under 35 U.S.C. Section 119(e), to U.S. Provisional Patent Application Ser. No. 60/743,318 entitled "Alternative Persistent State Recover Methods," filed on Feb. 17, 2006; U.S. Provisional Patent Application Ser. No. 60/747,496 entitled "Systems And Methods For Providing Alternative Persistent State Recovery Techniques In A Wagering Game Machine," filed on May 17, 2006; and U.S. Provisional Patent Application Ser. No. 60/828,888 entitled "Systems And Methods For Providing Alternative Persistent State Recovery Techniques In A Wagering Game Machine," filed on Oct. 10, 2006, the contents of which are incorporated herein by reference in their entirety for all purposes.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007 WMS Gaining, Inc.

FIELD

Embodiments of the inventive subject matter relate generally to wagering game machines, and more particularly, to wagering game machines including persistent state recovery.

BACKGROUND

Wager gaming machines, such as slot machines, video poker machines, and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are most likely attracted to the most entertaining and exciting of the machines. Consequently, shrewd operators strive to employ the most entertaining and exciting machines available because such machines attract frequent play and increase profitability for the operator. In the competitive wager gaming machine industry, there is a continuing need for manufacturers to produce new game types or to enhance entertainment and excitement associated with existing wager gaming machines.

In one type of gaming machine, a game may progress through a series of states. It may be desirable to discontinue play on one gaming machine or during a game session, and start up play on the same or a different gaming machine with the same state as the player left off. When a player carries a state of the game from one gaming session or gaming machine to another, it may be said that the state persists from one session or gaming machine to another. Such persistent state play can be used in many different ways to increase the enjoyment of players.

DETAILED DESCRIPTION

Example Operating Environment

Figure 1:
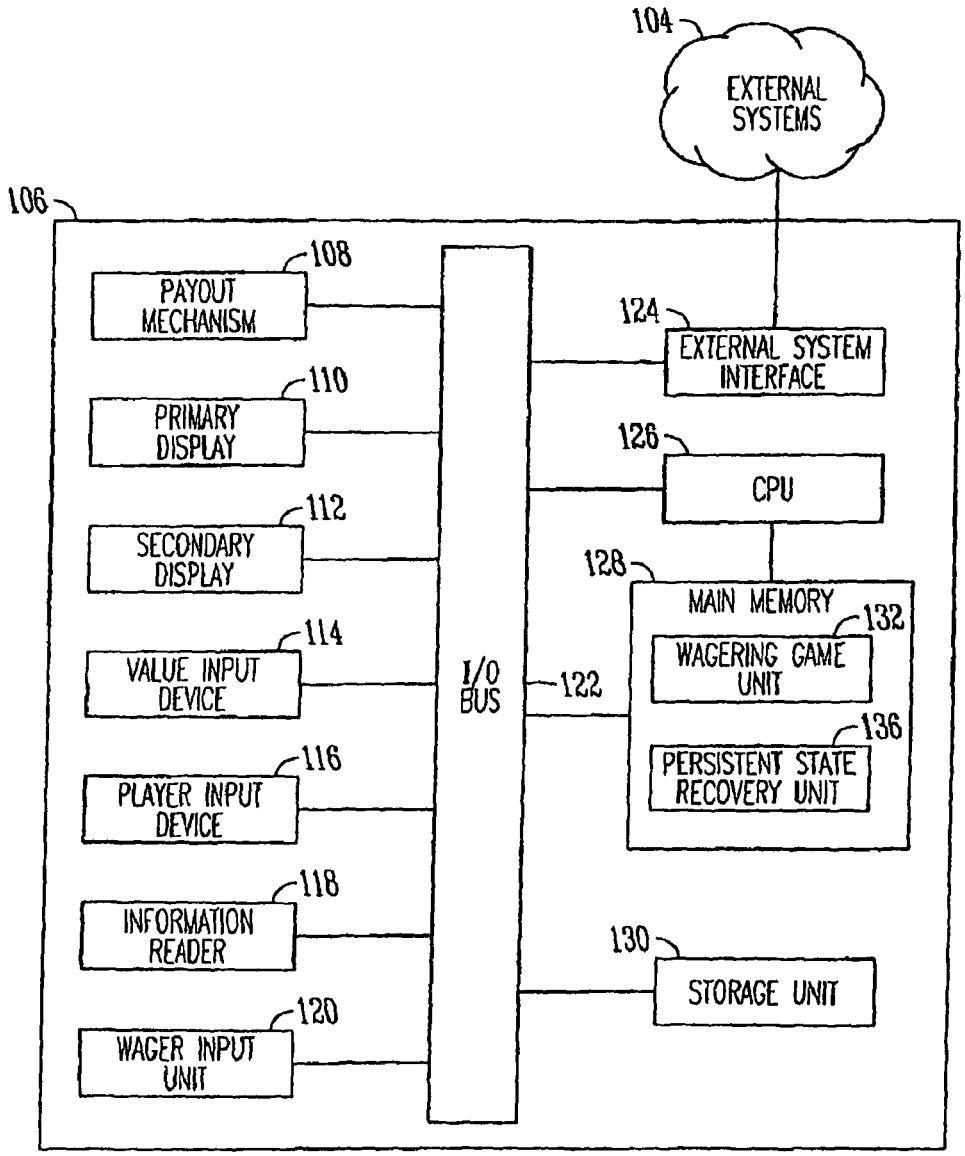
FIG. 1 is a block diagram of a wagering game machine architecture, including a control system, according to example embodiments of the invention and suitable for operating a wagering game machine.

FIG. 1 is a block diagram illustrating a wagering game machine, according to example embodiments of the invention. As shown in FIG. 1, the wagering game machine 106 includes a central processing unit (CPU) 126 connected to main memory 128, which includes a wagering game unit 132 and a persistent state recovery unit 136. In one embodiment, the wagering game unit 132 can receive wagers and conduct wagering games, such as video poker, video black jack, video slots, video lottery, etc. In one embodiment, the persistent state recovery unit 136 restores a state of a wagering game, as described herein.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, wager input unit 120, and storage unit 130. In certain embodiments, the player input device includes one or more of a button panel, a keyboard, and a touch screen display. In certain embodiments, the information reader includes one or more of a card reader, ticket reader, bar code scanner, RFID transceiver, a fingerprint scanner, computer readable storage medium interface, or other biometric input devices (e.g., a retinal scanner). In one embodiment, the wager input unit 120 can electronically receive wagering value (e.g., monetary value) from a player's casino account or other suitable "cashless gaming" value source. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 (e.g., the persistent state recovery unit 136) can include hardware, firmware, and/or software for performing the operations described herein. Furthermore, any of the components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
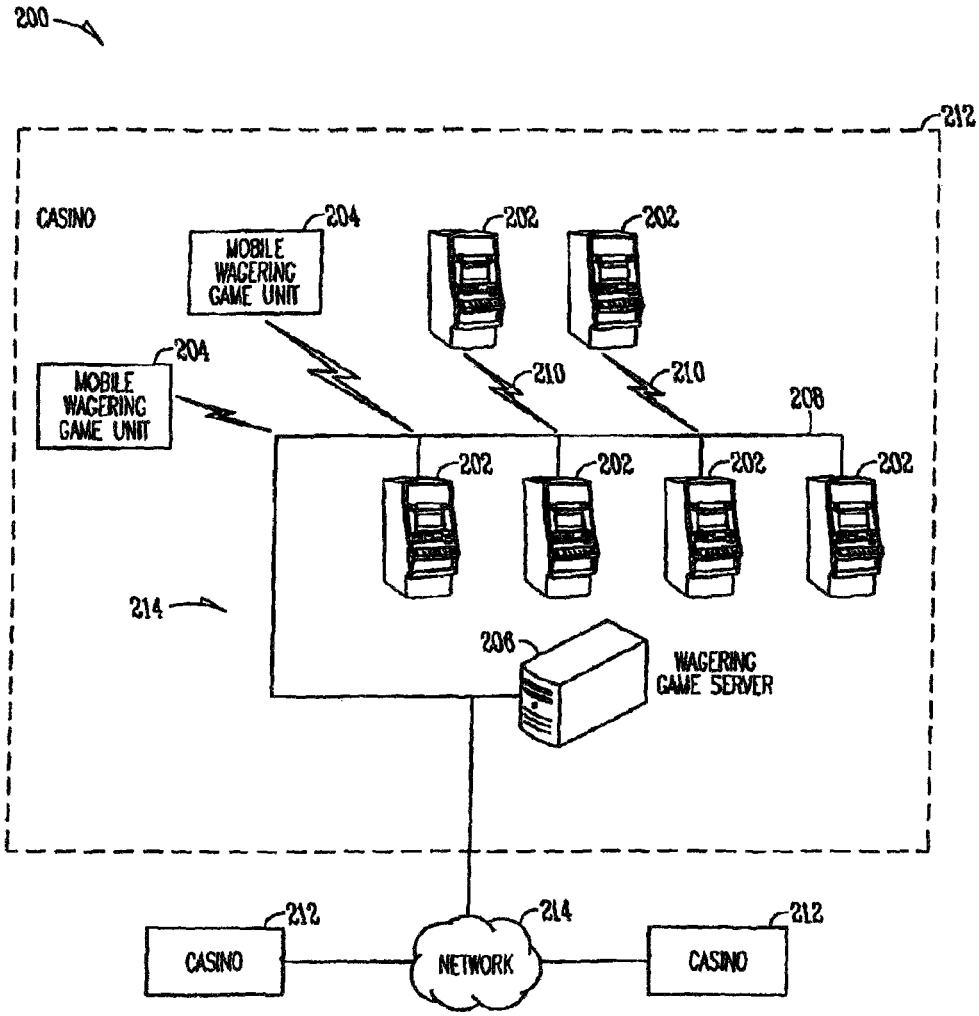
FIG. 2 is a block diagram illustrating a wagering game network, according to example embodiments of the invention.

While FIG. 1 describes example embodiments of a wagering game machine, FIG. 2 shows how a plurality of wagering game machines can be connected in a wagering game network.

FIG. 2 is a block diagram illustrating a wagering game network, according to example embodiments of the invention. As shown in FIG. 2, the wagering game network 200 includes a plurality of casinos 212 connected to a communications network 214.

Each of the plurality of casinos 212 includes a local area network 214, which includes wagering game machines 202 and mobile wagering game units 204 connected to a wagering game server 206. The wagering game machines 202, mobile wagering game units 204, and wagering game server 206 can include hardware and machine-readable media including instructions for providing persistent state recovery, as described herein. In one embodiment, the wagering game server 206 can perform persistent state recovery in concert with serving wagering games over the local area network.

The wagering game machines described herein can take any suitable form, such as floor standing models, handheld mobile units, bartop models, workstation-type console models, etc. In one embodiment, the wagering game network 200 can include other network devices, such as accounting servers, wide area progressive servers, and/or other devices suitable for use in connection with embodiments of the invention.

The components of each casino 212 can communicate over wired 208 and/or wireless connections 210. Furthermore, they can employ any suitable connection technology, such as Bluetooth, 802.11, Ethernet, public switched telephone networks, SONET, etc.

Example Operations

In some embodiments, a game machine 202, 204 can present a game that is configured and assembled into several units (i.e., episodes, chapters, stages, levels, etc.). The gameplay units can be arranged using various relationships, for example, a linear temporal relationship or progressive levels of difficulty. In an embodiment, a player is presented with an episodic game where each episode can include various challenges and rewards. If the player is successful in overcoming the challenges of an episode, then the game will present the player with a follow-on episode. In some embodiments, the follow-on episode is related to the previous episode such that a common theme or storyline is established throughout. The episodic nature of the game may capture a player's interest and compel them to complete the full storyline. However, players may not wish to repeat prior episodes that had been successfully traversed. In an embodiment, a game machine 202, 204 can provide a player one or more ways to bypass previous episodes and directly access a desired episode. Examples of techniques that can be made available to a player to retrieve or restore a particular state are described herein.

In an example embodiment, an access code is provided on a ticket. A ticket printer can be optionally included in the machinery of the game machine 202, 204 and when a player decides to quit or cash out of a game, a ticket is printed with a code to access the current game state. The ticket can include additional information unique to the user, such as a username and password for a game or game system. The ticket can also include identification of the game and an alphanumerical representation of the saved game state, such as "Star Trek, Episode 3, Chapter 9" to remind the player which state the ticket will restore. In some examples, the information on a ticket is provided in a bar code format. The information contained in the bar code can consist of more or less information than what is printed elsewhere on the ticket. When a player decides to resume the game, a ticket that contains information about a game state is provided to the game machine 202, 204. For example, the ticket may be fed into a ticket reader and the game machine 202, 204 can obtain the game state and other pertinent information from the ticket reader device. The ticket may be returned to the player for later use. Alternatively, the ticket may be read by an external reader, such as a bar code scanner.

In a further example, an access code is provided to a wireless ticket. A wireless ticket can include an RF transceiver to send and receive wireless signals and a storage device to store data. A player can position the wireless ticket in close proximity to a game machine 202, 204 at the end of a play session to save the game state. When the player wants to resume play, the wireless ticket containing information about a saved game state is accessed using wireless communications. To avoid accidentally reading other nearby wireless tickets, the wireless ticket only provides short-range wireless telemetry and the player must hold the wireless ticket in close proximity to an indicated area or device on the external housing of the game machine 202, 204. In other examples, the player must activate the restoring of a game state by both holding the wireless ticket near the game machine 202, 204 while interfacing with the game machine 202, 204, for example, by pressing an icon on the display or a mechanical button on the cabinet housing to activate the reading.

In a further example, to restore a game at a game state, the player can access a user interface on the game machine 202, 204 and provide information. For example, a player may touch a "begin" icon on the game machine's display. In reaction to the player's contact, the game can provide a user interface to receive information. In some examples, the user interface is an alphanumeric or iconic display. Alternatively, touching any portion of a screen display can trigger a login or access screen. The player can then enter information, e.g., an access code, to begin play at a particular stage of the game.

In a further example, major portions of a game (e.g., episodes) can be accessed using a simplified graphical user interface. For example, at the beginning of each episode, an icon paired with an alphanumeric string is used to identify the episode, such as "Spock 11," where "Spock" is a graphical or iconic representation of the character Spock. Using graphical or iconic representations of various characters from the television show Star Trek provides a simplified user interface and the combination of a recognizable character and a two-digit number allows easy access to the major portions of a game. However, in an example, to access sub-parts of the episode (e.g., chapters) a more detailed access code is used which may not be as readily memorized or recalled. In an embodiment, the player is given the option to print the icon-string pairing on a ticket for future reference.

In a further example, a user can maintain an account on a wagering game server 206, which is accessible by one or more game machines 202, 204, such as over a network 214. A user can access a user interface on a game machine 202, 204 and provide a username. In some examples, a user may also authenticate their identity by providing a password. Using the username, and optionally the password, the game machine 202, 204 can then obtain the saved state from the user's account. The user's account information may be stored on a computer on the network, such as the wagering game server 206. The user's account can optionally be saved on a wireless ticket that the user carries on their person. In additional embodiments, some or all of the user's authentication information (e.g., username and/or password) can be obtained by a game machine 202, 204 by reading a printed ticket, a wireless ticket, or biometric information (e.g., via a fingerprint scanner). Combinations of manual, automated or semi-automated methods are within the scope of this example. For example, a user could input a username using a user interface on a game machine 202, 204 and then be prompted to swipe a wireless ticket near a wireless ticket reader to obtain a passcode or other unique user authentication data from the user and complete the user authorization process.

In a further example, a user may have the ability to save or access user-account information over a wide-area network. In an embodiment, a user may access a account that includes user information (e.g., username, password, account information, persistent game state information) that may be accessed and used across multiple casinos, systems, or platforms. In other words, as an example, the account may be used to store the state of the game and can apply to multiple casinos, gaming networks, and platforms (e.g., traditional gaming machines, handhelds, PDAs, internet, etc.).

As an illustration, referring to FIG. 2, a user account may be stored on one or more wagering game servers 206 at one or more casinos 212, such that a user, when accessing the account can use the information associated with the account at which ever casino the user is currently occupying. In addition, the account may be accessible from a wagering game machine 202 or a mobile wagering game unit 204. In some embodiments, the mobile wagering game unit 204 is a wireless internet device that is operated off of the casino's premises. For example, the mobile wagering game unit 204 may include cellular telephone, a PDA, a laptop, a specialized portable gaming unit, or other computerized device that is capable of communicating over a network (e.g., the Internet) with the wagering game server 206.

In an embodiment, usernames and/or passwords are represented by one or more strings, which may include numeric characters (to form an alphanumerical string). In another embodiment, the username may comprise two elements, a graphical element and an alphanumerical element. The graphical element may include a pictographic icon, such as a character from the wagering game's theme (e.g., Spock, Kirk, Han Solo, etc.). The alphanumeric element may include a username, an access code, a random string of alphanumerical characters, or other strings. The two-part username may be used to access a player's account in some embodiments. Using icons or pictographic elements may provide a number of benefits. Visual cues may be easier to remember for some players. In addition, using a themed pictographic icon may add another attractive element to game play. Using graphical elements in combination with an alphanumerical element may also reduce the number of username collisions. For example, "Kirk-Mildred" is unique compared to "Spock-Mildred," but both Mildreds are able to use usernames they may prefer, and that may be easier for them to remember. In an embodiment, the player is given the option to print the username on a ticket for future reference.

Figure 3:
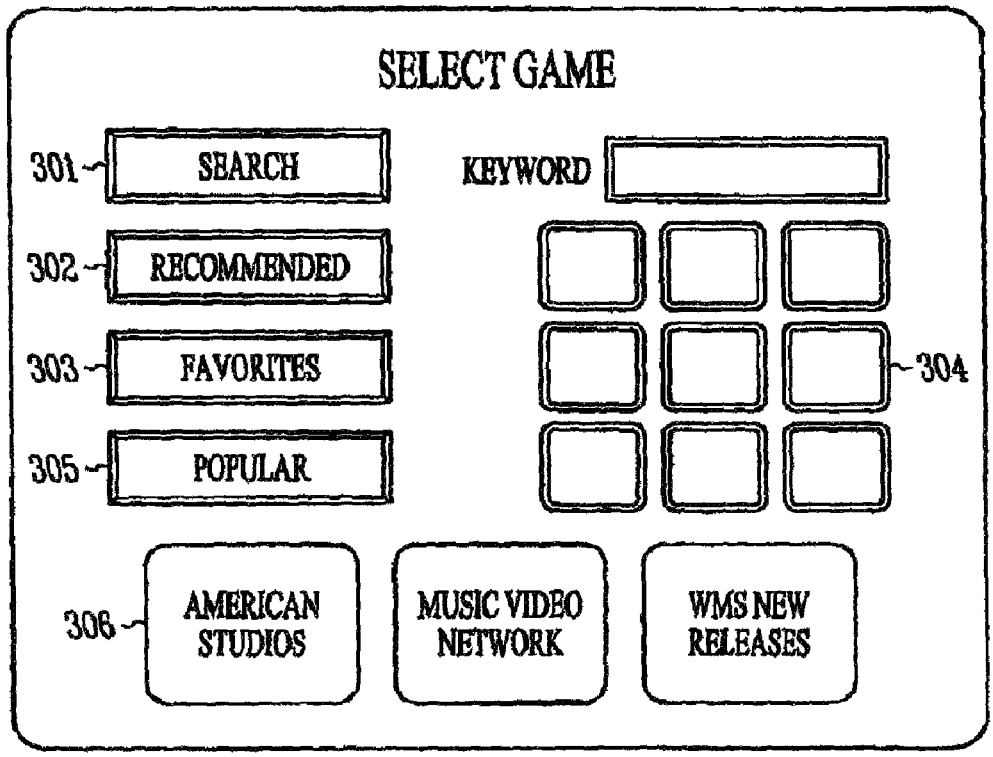
FIG. 3 is a screenshot illustrating a first portion of a process to create or use an identification for account access, according to example embodiments.
Figure 4:
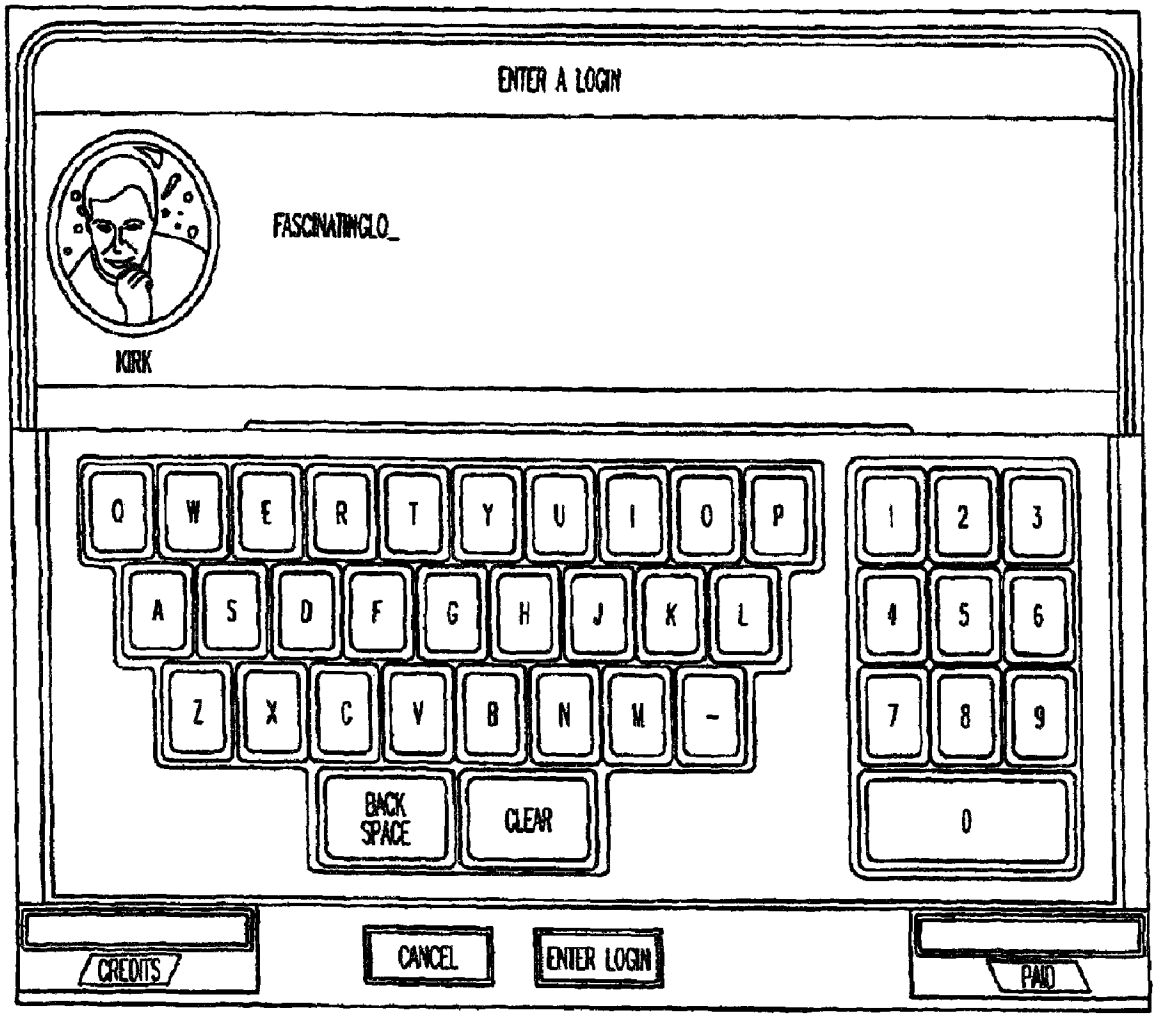
FIG. 4 is a screenshot illustrating a second portion of a process to create or use an identification for account access, according to example embodiments.
Figure 5:
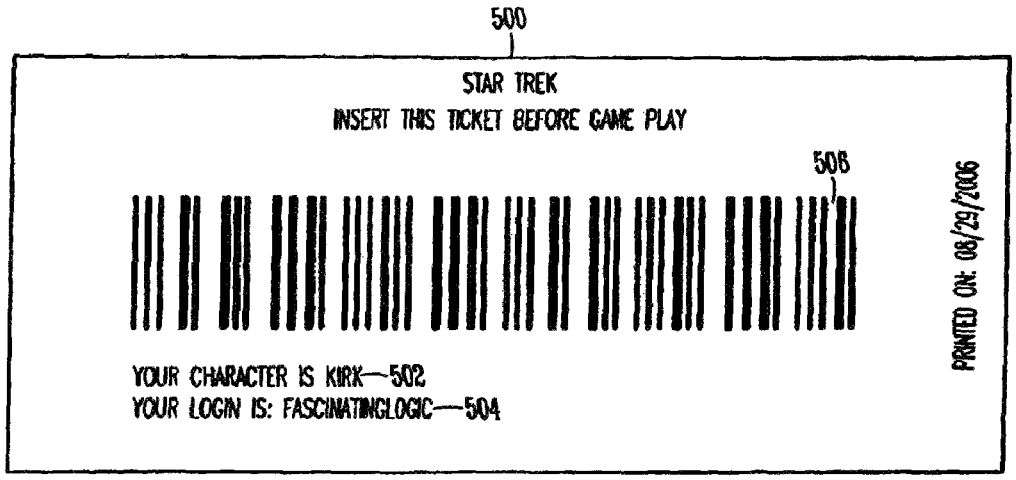
FIG. 5 illustrates a ticket, according to example embodiments.

FIG. 3 is a screenshot illustrating a first portion of a process to create or use an identification for account access, according to example embodiments. A user (e.g., player) may be presented with a screen, such as shown in FIG. 3, prompting the user to select an icon for use in an account identification scheme. A touch-screen display may be used, such that the user may touch an icon to select it. After an iconic personality is selected, the user may be directed to provide an alphanumeric username. FIG. 4 is a screenshot illustrating a second portion of a process to create or use an identification for account access, according to example embodiments. In FIG. 4, the user may use a touch-screen display to actuate one or more buttons as shown to provide an alphanumeric username. The example shown in FIG. 4 has a partially formed username of "FASCINATINGLOGIC," which when combined with the iconic personality selection of "KIRK" may provide some or all of the advantageous discussed above. To further assist the user in remembering the username chosen, a ticket may be printed and dispensed to the user. FIG. 5 illustrates a ticket 500, according to example embodiments. The ticket 500 may include a textual or iconic indication 502 of the iconic personality chosen and an alphanumeric string showing the login username 504. The ticket 500 may also include a bar code 506. In an example, the bar code is a 14-digit number, assigned by a server, which uniquely identifies the chosen personality and username combination, and may be used to automatically log a user into the system via a ticket reader.

In an embodiment, a server (e.g., wagering game server 206 at FIG. 2) may generate an identifier that uniquely identifies the username. The identifier may be numerical or alphanumerical. In addition, in some examples, the identifier may include an iconic element, similar to that described above. The identifier may be encoded in a bar code that may be printed on a ticket. Bar codes may be of a different length to differentiate a bar code used to uniquely identify a player or a player's state from bar codes used for a "cash" ticket. The ticket can then be used to access the player's account when resuming game play. In an embodiment, the ticket is fed into a ticket reader device and the game machine 202, 204 can use the encoded identifier to lookup the user's persistent state information and restore the player's persistent state. Alternatively, the ticket is read by an external reader, such as a bar code scanner, in an embodiment. In another embodiment, the player's username is encoded in a bar code on a ticket and used to retrieve the player's persistent state information.

In various embodiments, with regard to the examples described above, information provided by a user (e.g., a player) may represent the persistent game state. In an alternative embodiment, the information provided by the user represents an indicia to a location where persistent game state information is stored. For example, the user may provide a code, which represents an index to a record in a shared central database, where the record contains some or all of the data to restore a game state. In other embodiments, information provided by a user may represent hybrid information, where some of the hybrid information can be used to restore some part of a stored game state and other portions of the hybrid information can be used to retrieve additional data required to restore the game state.

In various embodiments, players may be prompted to create an account or a username and password combination during one or more game events. Game events may include a major game milestone (e.g., the completion of a phase of the game), at zero credits, or at cash out. In an embodiment, when a player reaches zero credits, the player is notified of the game status and given the opportunity to respond. Player responses may be actions, such as providing additional funds or logging out of their account and removing the machine from a gameplay mode. In an embodiment, when a player cashes out, the game automatically logs the player out from their account. In some embodiments, multiple instances of the same account or username and password combination may be used simultaneously, such that more that one game may be active and associated with the same player account. In such a configuration, a database or other storage mechanism may store the furthest progression of any of the running instances.

The following commonly assigned U.S. patent applications are related, and are herein incorporated by reference in their entirety: "Wagering Game Having Rule Set Modification," Ser. No. 11/289,894, filed on Nov. 30, 2005; "Sharing Game Assets In A Wagering Game Network," Ser. No. 60/700,933, filed on Jul. 20, 2005; "Wagering Game With Changed Game Indicia Over Multiple Gaming Sessions," Ser. No. 60/586,032, filed on Jul. 7, 2004; "Transient or Persistent Game Play in Wagering Games," Ser. No. 60/745,691, filed on Apr. 26, 2006, "Persistent State Systems, Methods and Software," Ser. No. 60/747,234, filed on May 15, 2006.

In an embodiment, two or more modes (techniques) of storing and/or restoring a game state are available to a game player. In an embodiment, the modes are accessible in a hierarchical order. In an embodiment, the modes are accessible in a linear progression.

Figure 6:
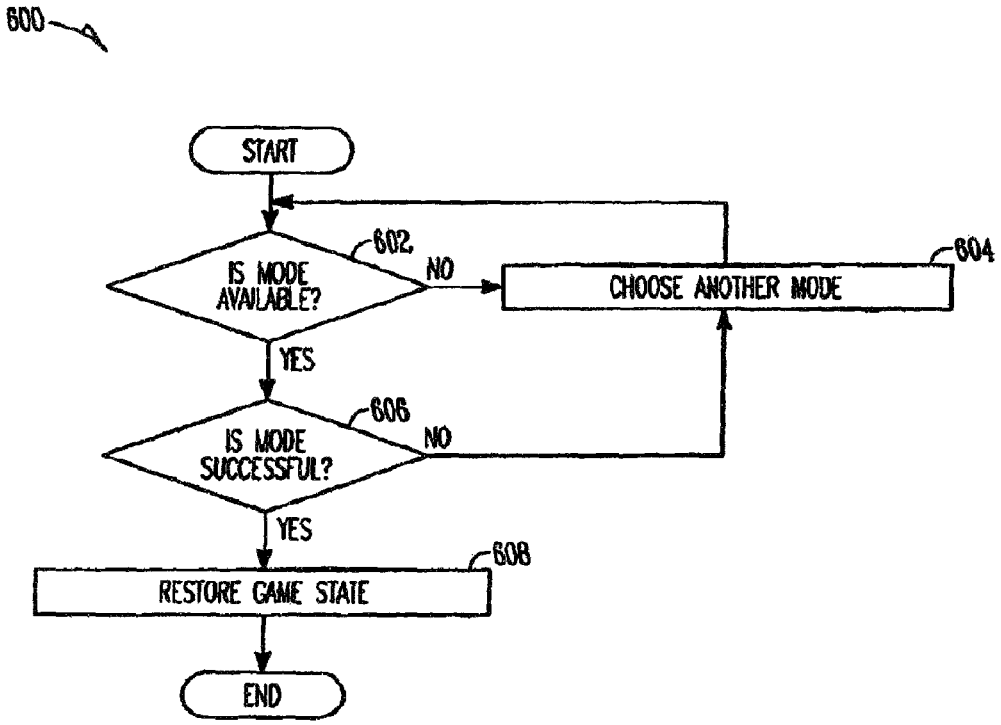
FIG. 6 is a flowchart illustrating generally a method of persistent state recovery in a game machine, according to example embodiments.

FIG. 6 is a flowchart illustrating a method 600 of restoring a game state using one of a plurality of modalities, according to example embodiments. At 602, the method determines if a first technique is available. For example, a player may have a ticket issued from a previous play session. However, because of some reason, the ticket is unusable (e.g., the ticket reader does, not recognize it) or unavailable (e.g., lost or destroyed).

Figure 7:
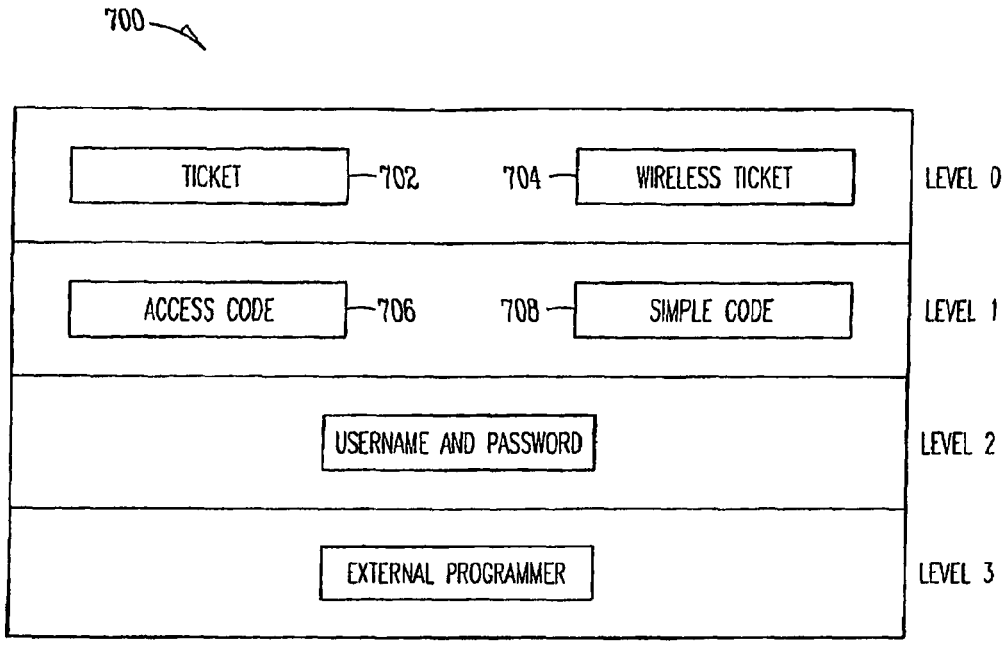
FIG. 7 illustrates an exemplary hierarchy of various techniques to restore a game state, according to example embodiments.

If the first mode is unavailable or unsuccessful, then at 604 the method 600 determines if another mode is available. In an embodiment, a subsequent mode is chosen based on a hierarchical ordering. The hierarchical ordering can be arranged based on preferences such as ease of use, involvement of administrative users, or other factors. FIG. 7 illustrates an exemplary hierarchy 700 of five techniques to restore a game state, according to example embodiments. At a first level of the hierarchy, "Level 0," the method 600 will preferably use a ticket 702 or a wireless ticket 704 to restore a game. If those modes are unavailable, then the method 600 will advance through the hierarchy to "Level 1" and use either an on-screen access code 706 or an on-screen code 708. In various embodiments, codes with complexities ranging from simple to complex may be used. Continuing in a similar manner, if the modes of operation at Level 1 are unavailable, then the method 600 will continue to traverse the hierarchy to "Level 2" and so on.

In an embodiment, a subsequent mode is chosen at 604 based on a linear progression. For example, a casino may provide three modes to restore a game state, such as a ticket, an on-screen access code, and an external programming device. If a player loses or damages a ticket such that it becomes unusable, the player can then attempt to recall the access code to input it using a graphical user interface. In the case that a player cannot remember the access code to input it manually, then a casino employee can use an external programmer, such as a wireless remote, to trigger a restoration of a game state in a particular machine. The last mode may be less desirable over the first two modes because of the additional overhead involved (e.g., staffing, training, security). Other linear progressions may be constructed based on one or more factors.

In an embodiment, the method 600 requires that at least one mode is attempted before providing modes that occur later in the sequence. For example, when using a hierarchical sequence, a user may have to show an administrative person (e.g., a casino floor manager) that a ticket is lost or damaged before the method 600 allows the use of an access code. The method may detect this initial failure with the assistance of various input modalities. For example, if a user loses their ticket, an on-screen confirmation screen can be provided to indicate to the method 300 that the mode was unavailable.

If all of the modes available have been attempted and failed or are indicated as unavailable, then the method 600 ends at 604. If the player is unable to use any mode to restore the desired game state, the player can begin a new game or attempt to use a different code to access a different game state.

If there is an available mode, then at 606, the method 600 determines if the mode is successful. For example, a player can attempt to input an access code using a graphical user interface on a game machine 202, 204. If the player inputs the incorrect code, then the game machine 202, 204 can give the player a second chance. In an embodiment, a threshold is provided that limits the number of attempts to restore a game state. For example, if the player exceeds a threshold number of attempts, then the player's attempt at entering a valid code is considered a failure and the method 600 will proceed to end at block 604. Additionally, an alarm or other game condition (e.g., tilt) can be used to alert game machine proprietors. If a mode is successful, then at 608, the game is restored to the state corresponding with the access code.

Figure 8:
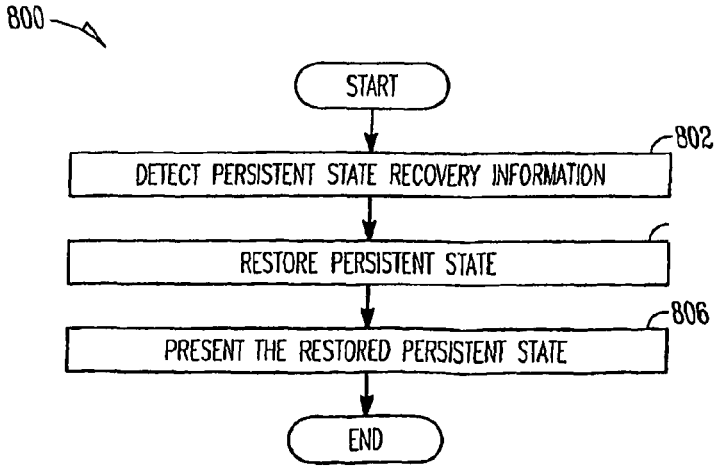
FIGS. 8 and 9 are flowcharts illustrating generally methods of persistent state recovery in a game machine, according to example embodiments.

FIG. 8 is a flowchart illustrating generally another method 800 of persistent state recovery in a game machine, according to example embodiments. At 802, the method 800 detects persistent state recovery information. In an embodiment, the method 800 is able to detect such persistent state recovery information from two or more persistent state recovery techniques, for example, the techniques described above. After detecting the information, the method 800 uses the persistent state information to restore an associated persistent game state. The method 800 then presents 806 the restored game to a user for game play.

Figure 9:
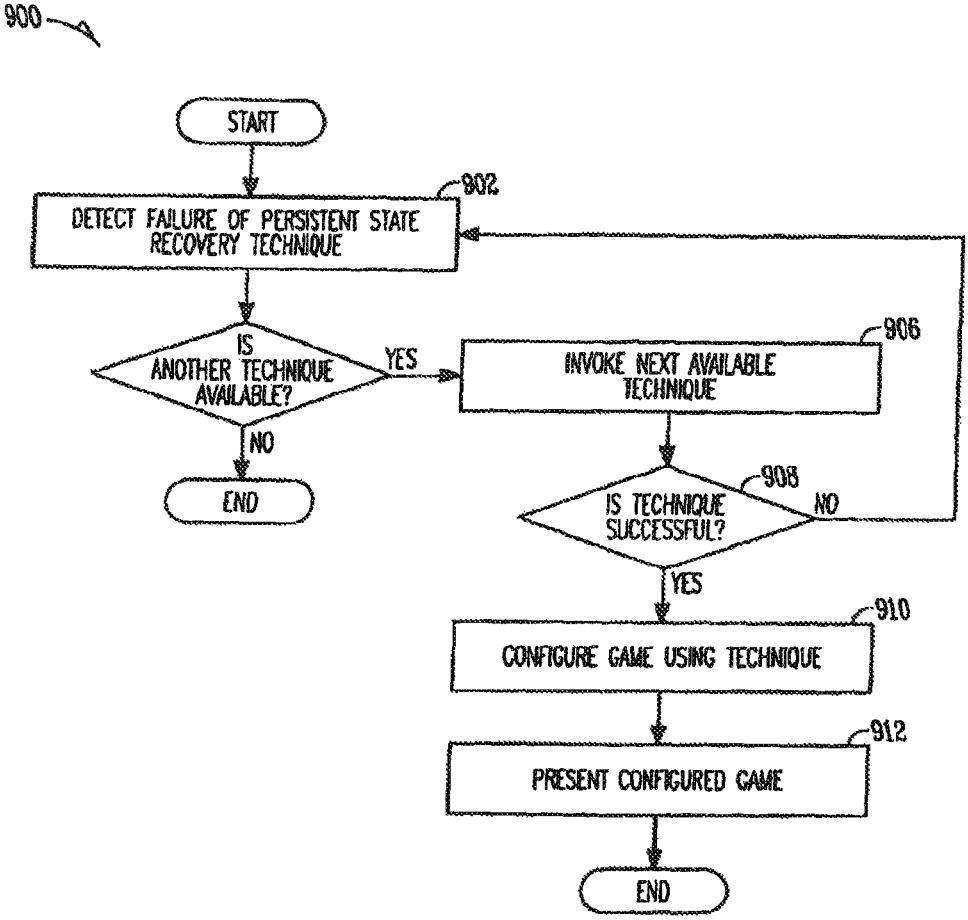

FIG. 9 is a flowchart illustrating generally another method 900 of persistent state recovery in a game machine, according to example embodiments. At 902, the method 900 detects a failure of a persistent state recovery technique. For example, the failure may be that a paper ticket is unable to be properly read by a ticket reader. Other examples of detectable failures include an incorrect username and password combination entered through a user interface and an unrecognizable access code either entered through an on-screen user interface or alternatively, provided by an RFD device. After a failure is detected, the method 900 determines if another persistent state recovery technique is available. In some embodiments, the various available persistent state recovery techniques are arranged or available in a particular sequence, for example, in a hierarchical or linear order. If another technique is not available, the method 900 ends. However, if there is another technique available, it is invoked 906 and the method 900 determines whether the new technique is successful 908. If the new technique also fails, then the method 900 detects the failure 902 and the method 900 iterates to the next available technique. Alternatively, if the technique is determined to be successful, then the game is configured 910 to the associated persistent game state. Once the game is configured, then it is presented 912 to the user or player.

In some embodiments, after a user has successfully accessed a saved persistent game state configuration, systems and methods may provide the user with additional saved persistent game states, for example, through a user interface. The user may then choose one of the game states to resume. In response to the choice, systems and methods can configure the wagering game accordingly and present the reconfigured game to the user. For example, in an episodic game with ten levels, a user who has progressed to level eight may use the described systems and methods to access any previously completed level (e.g., levels one through seven) after successfully accessing the persistent state of level eight.

Example Wagering Game Machine

Figure 10:
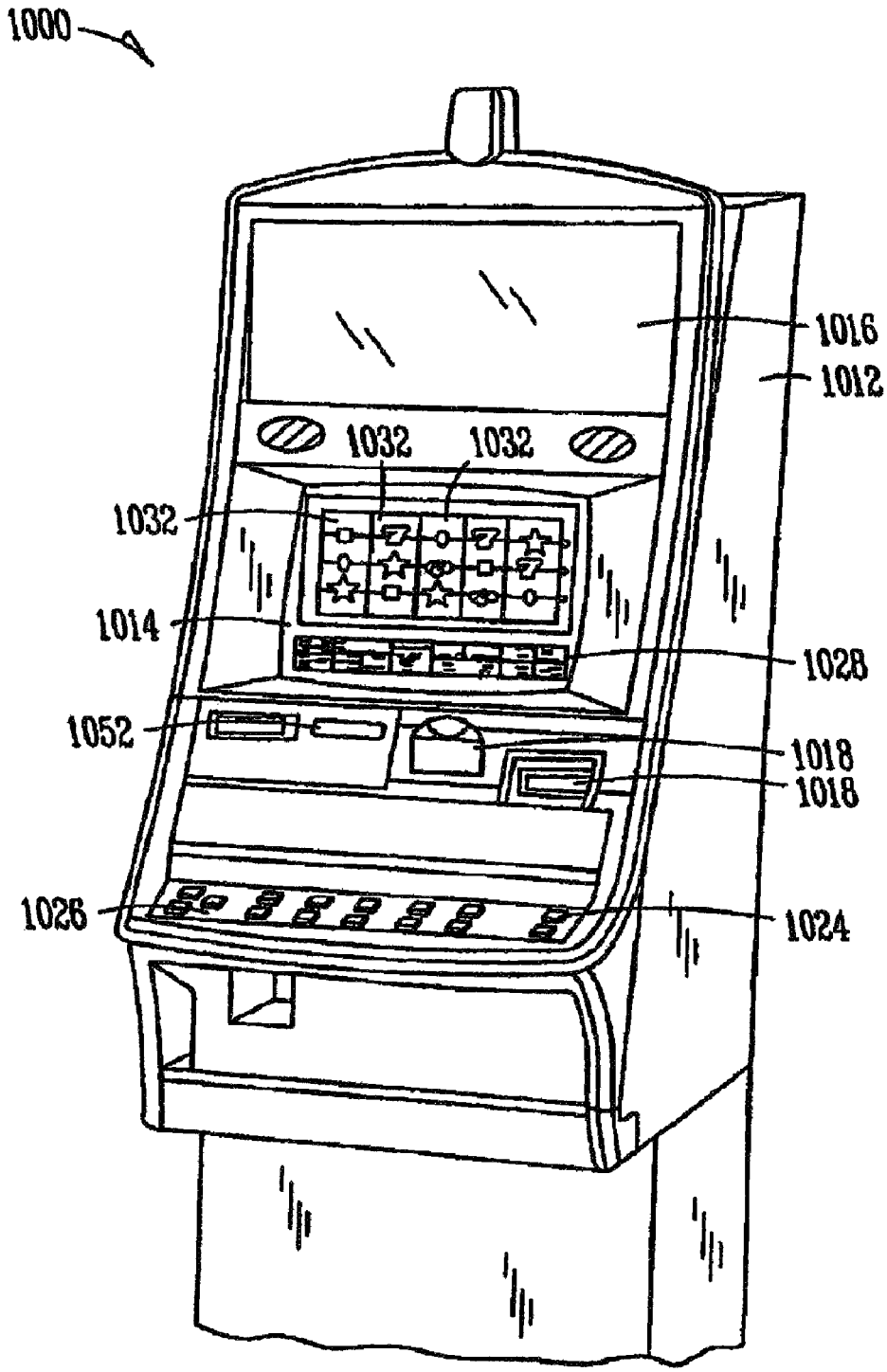
FIG. 10 is a perspective view of a wagering game machine, according to example embodiments.

FIG. 10 is a perspective view of a wagering game machine, according to example embodiments of the invention, according to example embodiments. Referring to FIG. 10, a wagering game machine 1000 is used in gaming establishments, such as casinos. According to embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or bar code scanners for reading information stored on vouchers, cards, or other tangible portable storage devices. The vouchers or cards can authorize access to central accounts, which can transfer money to the wagering game machine 1000. Bar code scanners may also be capable of reading and differentiating account-access bar codes from cash-substitute bar codes.

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can be a bartop model, a mobile handheld model, or a workstation console model.

A player begins playing a basic wagering game by making a wager via the value input device 1018. The player can initiate play by using the player input device's buttons or touch screen 1028. The basic game can include arranging a plurality of symbols along a payline 1032, which indicates one or more outcomes of the basic game. Such outcomes can be randomly selected in response to player input. At least one of the outcomes, which can include any variation or combination of symbols, can trigger a bonus game.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

In some embodiments, the wagering game machine 1000 can also include an information reader, which can include a card reader, ticket reader, bar code scanner, RFID transceiver, or computer readable storage medium interface. In some embodiments, the information reader can be used to award complimentary services, restore game assets, track player habits, etc.

In some embodiments, the wagering machine is a stand alone gaming device, a mobile gaming device, or a gaming device in a server-based gaming system.

General Comments

In the above detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The above detailed description does not, therefore, limit embodiments of the invention, which are defined only by the appended claims.

Each of the embodiments described herein are contemplated as falling within the inventive subject matter, which is set forth in the following claims.

What is claimed is:

1. A computer-implemented method of restoring a persistent game state of a wagering game, the wagering game being assembled into multiple game states and progressing through one or more of the game states during game play, the method comprising:

detecting a first input from a player, via at least a first input device, representing game state information related to a game state of the multiple game states of the wagering game, the first input being in accordance with a first technique of a plurality of different persistent state recovery techniques;

in response to detecting the first input, attempting, by one or more processors applying the first technique to the first input, a first identification of the game state related to the game state information;

in response to the first identification failing, detecting a second input from the player, via a second input device, representing the game state information relating to the game state, the second input being in accordance with a second technique of the plurality of different persistent state recover techniques;

in response to detecting the second input, attempting, by the one or more processors applying the second technique to the second input, a second identification of the game state;

in response to at least the second identification being successful, restoring, by one or more processors obtaining the game state from a game server on a gaming network, the wagering game to the game state; and presenting the wagering game to the player in the restored game state.

2. The method of claim 1, wherein the second input comprises a player game ticket, the second input device comprises a ticket reader, and applying the second technique comprises reading the game state information on the player game ticket.

3. The method of claim 1, wherein the first input device and the second input device are the same device.

4. The method of claim 1, wherein the game state information comprises player account access information.

5. The method of claim 1, wherein the techniques of the plurality are invoked according to a predetermined order.

6. The method of claim 5, wherein the predetermined order is based on one of technique ease of use and requirement for administrative involvement.

7. A computer system configured to restore a persistent game state of a wagering game, the wagering game being assembled into multiple game states and progressing through one or more of the game states during game play, the system comprising:

at least a first and second input device;

one or more processors; and at least one memory device storing instructions that, when executed by at least the one or more processors, cause at least the one or more processors to operate with the first and second input devices to detect a first input from a player, via the first input device, representing game state information related to a game state of the multiple game states of the wagering game, the first input being in accordance with a first technique of a plurality of different persistent state recovery techniques;

in response to detecting the first input, attempt a first identification of the game state by applying the first technique to the first input;

in response to the first identification failing, detecting a second input from the player, via the second input device, representing the game state information relating to the game state, the second input being in accordance with a second technique of the plurality of different persistent state recovery techniques, and wherein the second input comprises at least one of a username and a password, and provides access to a player account storing information that specifies the game state;

in response to detecting the second input, attempt a second identification of the game state by applying the second technique to the second input;

in response to the second identification being successful, restore the wagering game to the game state; and present the wagering game to the player in the restored game state.

8. The computer system of claim 7, wherein the one or more first processors include a detecting processor and a restoring processor.

9. The computer system of claim 7, wherein the first input device and the second input device are the same device.

10. The computer system of claim 7, wherein the second input device is a graphic user interface.

11. The computer system of claim 7, wherein at least one of the one or more processors and the at least one memory device resides in a game server on a gaming network.

12. The computer system of claim 7, wherein the restored game state is downloaded from a game server on a gaming network to a gaming machine, for presentation to the user.

13. The computer system of claim 7, wherein the techniques of the plurality are invoked according to a predetermined order.

14. A computer-readable, non-transitory medium having instructions including a plurality of different persistent state recovery techniques, the instructions, when executed by one or more processors, cause the one or more processors to perform the method comprising:

detecting a first input from a player, via at least a first input device, representing game state information related to a game state of the multiple game states of the wagering game, the first input being in accordance with a first technique of the plurality of different persistent state recovery techniques;

in response to detecting the first input, attempting, by the one or more processors applying the first technique to the first input, a first identification of the game state;

in response to the first identification failing, detecting a second input from the player, via a second input device, representing the game state information relating to the game state, the second input being in accordance with a second technique of the plurality of different persistent state recovery techniques;

in response to detecting the second input, attempting, by the one or more processors applying the second technique to the second input, a second identification of the game state;

in response to the second identification being successful, restoring, by one or more processors obtaining the game state from a game server on a gaming network, the wagering game to the game state; and presenting the wagering game to the player in the restored game state.

15. The computer-readable medium of claim 14, wherein the medium resides on a game server on a gaming network.

16. The computer-readable medium of claim 15, wherein the second input device comprises a mobile wagering game unit communicating with the game server over the gaming network.

17. The computer-readable medium of claim 16, wherein the mobile wagering game unit is one of a cellular telephone, a PDA, a laptop computer, and a specialized portable gaming unit.

18. The computer-readable medium of claim 14, wherein the first input device and the second input device are the same device.

* * * * *

UNITED STATES PATENT AND TRADEMARK OFFICE

CERTIFICATE OF CORRECTION

PATENT NO. : 8,216,058 B2
APPLICATION NO. : 12/279834
DATED : July 10, 2012
INVENTOR(S) : Anderson et al.

It is certified that error appears in the above-identified patent and that said Letters Patent is hereby corrected as shown below:

On page 2, in column 2, under "Other Publication", line 4, delete "12/158,855 ," and insert --12/158,855,--, therefor On page 2, in column 2, under "Other Publication", line 10, after "Harry", delete "J," and insert --J.,--, therefor On page 2, in column 2, under "Other Publication", line 11, delete "26-29,38-42,44." and insert --26-29, 38-42, 44.--, therefor On page 2, in column 2, under "Other Publication", line 13, delete "203-205,264-266." and insert --203-205, 264-266.--, therefor On page 2, in column 2, under "Other Publication", line 15, delete "881-883,917-918,932-933." and insert --881-883, 917-918, 932-933.--, therefor In column 1, line 32, delete "Gaining" and insert --Gaming--, therefor In column 7, line 45, delete "does, not" and insert --does not--, therefor In column 7, line 61, delete "Level 1" and insert --"Level 1"--, therefor In column 8, line 61, delete "RFD" and insert --RFID--, therefor In column 11, line 65, in Claim 7, after "to", insert --:--, therefor Signed and Sealed this
Fourth Day of December, 2012

David J. Kappos

David J. Kappos
*Director of the United States Patent and Trademark Office*